US007548025B2

(12) United States Patent
Goihl et al.

(10) Patent No.: US 7,548,025 B2
(45) Date of Patent: Jun. 16, 2009

(54) ELECTRIC LAMP HAVING RETAINING PINCHES FOR THE LUMINOUS ELEMENT

(75) Inventors: Rupert Goihl, Steinsdorf (DE); Roland Stark, Wellheim (DE)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 478 days.

(21) Appl. No.: 11/412,043

(22) Filed: Apr. 27, 2006

(65) Prior Publication Data

US 2006/0244383 A1 Nov. 2, 2006

(30) Foreign Application Priority Data

Apr. 28, 2005 (DE) ..... 10 2005 019 829

(51) Int. Cl.
*H01J 17/16* (2006.01)
*H01J 61/30* (2006.01)

(52) U.S. Cl. ..... 313/634; 313/428; 313/317; 313/325; 313/318.07; 313/318.11

(58) Field of Classification Search ..... 313/627–643, 313/623–625, 634–636, 493, 318.12, 570, 313/567
See application file for complete search history.

(56) References Cited

U.S. PATENT DOCUMENTS

| | | | | | |
|---|---|---|---|---|---|
| 2,116,722 | A * | 5/1938 | Downer | 313/315 |
| 3,080,497 | A * | 3/1963 | Noel et al. | 313/43 |
| 5,146,134 | A * | 9/1992 | Stadler et al. | 313/579 |
| 5,896,004 | A * | 4/1999 | Feldman et al. | 313/493 |
| 5,932,955 | A * | 8/1999 | Berger et al. | 313/318.02 |
| 5,962,973 | A * | 10/1999 | Rice | 313/580 |
| 6,075,318 | A * | 6/2000 | Noll et al. | 313/573 |
| 7,119,484 | B2 * | 10/2006 | Damm et al. | 313/318.01 |
| 7,341,469 | B2 * | 3/2008 | Frye | 439/236 |
| 7,397,192 | B2 * | 7/2008 | Damm et al. | 313/634 |
| 2004/0120145 | A1 * | 6/2004 | Damm et al. | 362/226 |
| 2005/0093454 | A1 * | 5/2005 | Fridrich | 313/634 |
| 2006/0238121 | A1 * | 10/2006 | Stark | 313/569 |

FOREIGN PATENT DOCUMENTS

| | | | |
|---|---|---|---|
| DE | 40 08 367 | | 9/1991 |
| DE | 195 28 686 | A1 | 2/1997 |
| DE | 101 46 877 | | 4/2003 |
| EP | 0 446 460 | A2 | 9/1991 |
| EP | 446458 | A * | 9/1991 |
| EP | 0 616 359 | A1 | 9/1994 |
| FR | 453 758 | A | 7/1913 |
| JP | 07320698 | A * | 12/1995 |

* cited by examiner

*Primary Examiner*—Sikha Roy
*Assistant Examiner*—Jose M Diaz

(57) ABSTRACT

The invention proposes a lamp (1), in particular a halogen incandescent lamp for system voltage, having a luminous element (8), which is retained by pinches (10*a*, 10*b*) which are in the form of funnel-shaped turned-in sections in the end face (3) of the lamp vessel (2), the pinches (10*a*, 10*b*) being oriented essentially axially with respect to the longitudinal axis of the lamp (1).

16 Claims, 5 Drawing Sheets

ELECTRIC LAMP HAVING RETAINING PINCHES FOR THE LUMINOUS ELEMENT

TECHNICAL FIELD

The invention relates to an electric lamp, in particular a halogen incandescent lamp, having retaining pinches for the luminous element.

With this type of lamp, the luminous element is retained by means of funnel-like turned-in sections of the lamp vessel. For reasons of simplicity, these turned-in sections are also referred to as pinches below.

BACKGROUND ART

Such a lamp is known, for example, from the specification DE 40 08 367 A1. This document has disclosed a halogen incandescent lamp which has a pinch seal at one end and whose elongate luminous element extends in the direction of the longitudinal axis of the lamp and is held there by one or more pinches formed in the manner of funnels from the lamp vessel material. For this purpose, the pinches are oriented perpendicularly with respect to the lamp longitudinal axis. In one exemplary embodiment, the halogen incandescent lamp with a pinch seal at one end is incorporated in an outer bulb having an Edison screw base, for direct operation using the system voltage.

The specification U.S. Pat. No. 5,686,794 has disclosed a halogen incandescent lamp, whose elongate luminous element is axially centered using at least three pinches in the lamp vessel. In this case too, the pinches are oriented perpendicularly or radially with respect to the lamp longitudinal axis. Both lamps having a pinch seal at one end and tubular line lamps are disclosed.

The specification U.S. Pat. No. 6,724,135 B2 has disclosed a reflector lamp having a reflector and a halogen incandescent lamp using the bulb pinch technology. The pinches are formed perpendicularly with respect to the lamp longitudinal axis. The halogen incandescent lamp is introduced into the reflector coaxially with respect to the reflector axis.

DISCLOSURE OF THE INVENTION

The object of the present invention is to broaden the use and application possibilities for electric lamps using the bulb pinch technology.

This object is achieved by an electric lamp having

- a lamp vessel,
- a lamp base, which adjoins one end of the lamp vessel and, as a result, defines a lamp axis,
- a luminous element, which is located within the lamp vessel and is arranged essentially in an imaginary plane which is oriented perpendicularly with respect to the lamp axis,
- pinches, which are formed by turned-in sections of the lamp vessel and extend essentially parallel to the lamp axis, the pinches at least partially retaining the luminous element.

The pinches as such, as is already known from the prior art cited initially, are in the form of funnel-shaped turned-in sections of the lamp vessel. In contrast to the prior art, according to the invention, the pinches are, however, oriented essentially axially with respect to the longitudinal extent of the lamp ("axial pinches"), instead of perpendicularly with respect to the lamp longitudinal axis. The basic idea behind this is to align the luminous element of the lamp, usually an incandescent filament, possibly also wound several times and/or comprising a plurality of filament segments, essentially in an imaginary plane perpendicularly with respect to the lamp longitudinal axis, that is to say with respect to the direction of the lamp base and not essentially in the axial direction of the lamp, as in the prior art. This makes it possible, according to the invention, for the light to be emitted from the beginning predominantly through the end side of the lamp, i.e. in the axial direction. In this case, it is irrelevant if the luminous element is not completely or quite precisely stretched in one plane, for example if the individual filament segments are oriented obliquely with respect to the imaginary plane. It is merely critical that the principal extent of the luminous element is overall perpendicular with respect to the lamp longitudinal axis, i.e. for it to be at all possible for the luminous element to be retained by means of axial pinches.

In any case, in the cited prior art the light is initially predominantly emitted radially, on the other hand, owing to the axial arrangement of the incandescent filaments. For the light to be emitted predominantly axially, a separate reflector is required in the case of previous lamps using the bulb pinch technology, such as in the case of the reflector lamp in U.S. Pat. No. 6,724,135 B2 cited above.

Owing to the above-explained concept, the invention is in particular also suitable for high-volt (HV) halogen incandescent lamps which can be operated directly using the system voltage. The plurality of filament segments usually required for this purpose are essentially stretched in an imaginary plane perpendicular to the lamp longitudinal axis, for example in the form of a polygon which is open on one side, in any case such that the two inner power supply lines can be connected to the luminous element at a suitable distance from one another. In general, an incandescent filament which has filament segments with the number N is preferably stretched in the form of an N+1-sided polygon, which is open on the side of the two power supply lines of the incandescent filament.

The lamp vessel is preferably bowl-shaped with an overall planar or else slightly concave or convex end face for emitting the light. The axial pinches extend, starting from the end face, up to the incandescent filament in order to at least partially fix said incandescent filament. In this regard, the end face is strictly speaking not completely planar but is locally uneven owing to the turned-in pinches. For reasons of simplicity, the end face is in this case referred to as overall planar, however.

The number of pinches typically required depends on the length of the filament or on the number of filament segments. In each case one pinch is preferably provided between two adjacent filament segments and in each case one pinch is provided at the two power supply lines of the filament. If the number of filament segments is N, there are consequently N+1 pinches. In the case of an incandescent filament having, for example, a total of three filament segments, in each case one pinch is preferably provided at the two filament power supply lines and in each case one further pinch is preferably provided between the two connecting sections of the three segments, i.e. in total four pinches.

For this purpose, an uncoiled connecting section or a connecting section having a single coil can, for example, be embedded or fused in between the filament segments in the respective pinch tip in the region of a pinch. Alternatively, the incandescent filament is provided with in each case one secondary winding in the region of the pinches, with which secondary windings the incandescent filament is retained fixedly at the pinch tips, possibly also in combination with being fused in. Alternatively, the incandescent filament can also be, as it were, stretched via the pinches by the incandescent filament being passed, under stress, to the outside around the pinches. In the case of compact lamps, the pinches can also partially overlap one another, in particular in the region of the connection between the incandescent filament and the inner power supply lines, which extend relatively close to one another, for reasons of space.

The bowl-shaped lamp vessel preferably has a conical section, which tapers in the direction of the base and is preferably provided with a reflective coating and thus acts as an optical reflector. Since the contour of the lamp vessel is thus finally similar to an axial reflector, the light emission is as a result assisted in the axial direction. The axial arrangement of the pinches on the end face of the lamp vessel has the advantage in this context that the reflector coating remains completely planar and thus optically undisturbed, which favors uniformity of the axially emitted light distribution.

This achieves a very compact reflector lamp, in particular for high-volt operation. In this context, it is advantageous to provide the lamp according to the invention with a lamp base which is formed from the material of the lamp vessel, usually glass, for example with a G9 base or another type of base.

BRIEF DESCRIPTION OF THE DRAWINGS

The invention will be explained in more detail below with reference to exemplary embodiments. In the figures.

BEST MODE FOR CARRYING OUT THE INVENTION

Figure 1A:
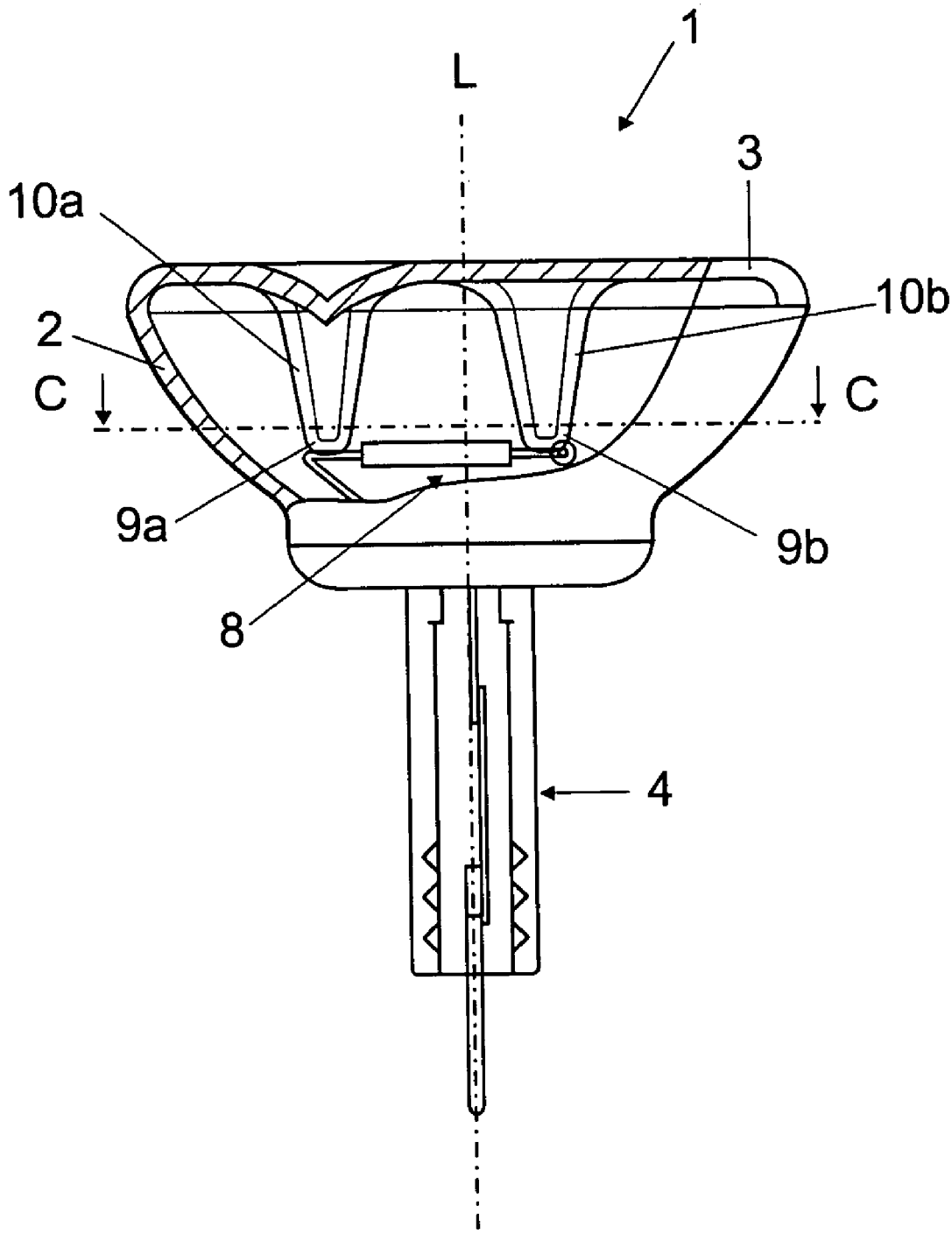
FIG. 1*a* shows a partially sectioned side view of a reflector lamp according to the invention.
Figure 1B:
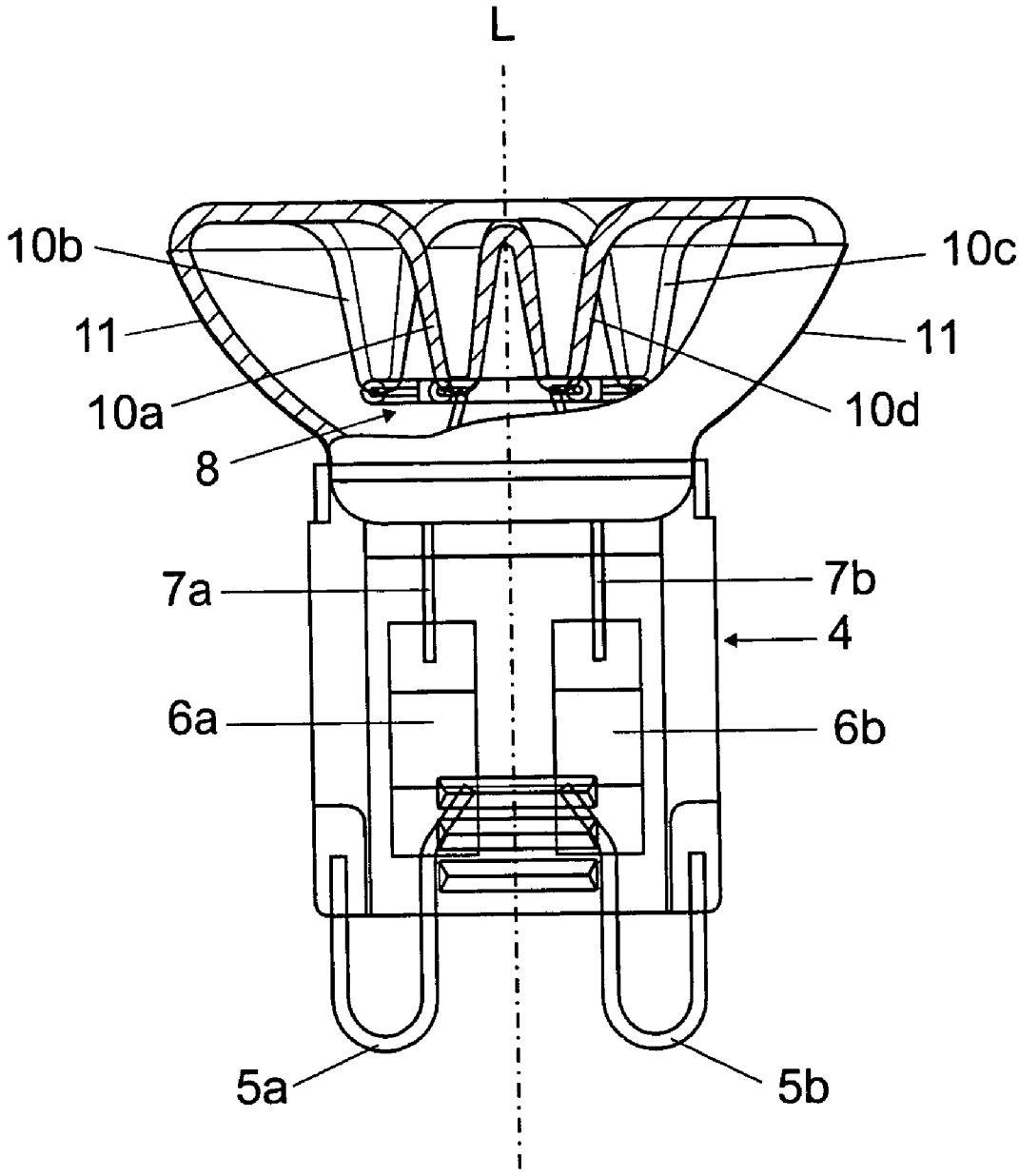
FIG. 1*b* shows a partially sectioned side view, rotated through 90° compared with FIG. 1*a,* of the reflector lamp according to the invention shown in FIG. 1*a,*
Figure 1C:
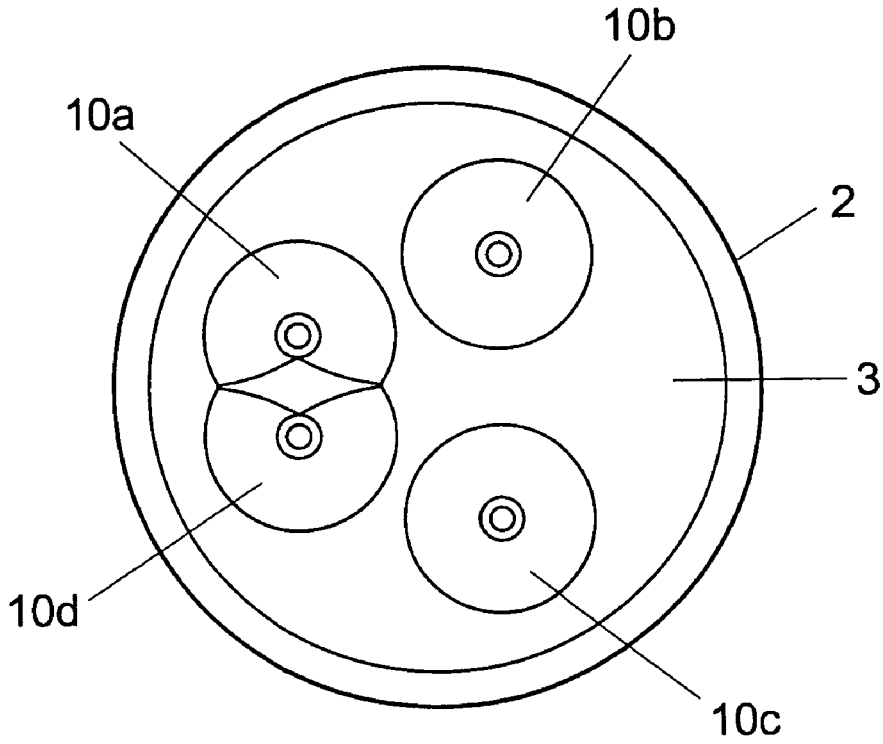
FIG. 1*c* shows an end view of the reflector lamp according to the invention shown in FIG. 1*a,*
Figure 1D:
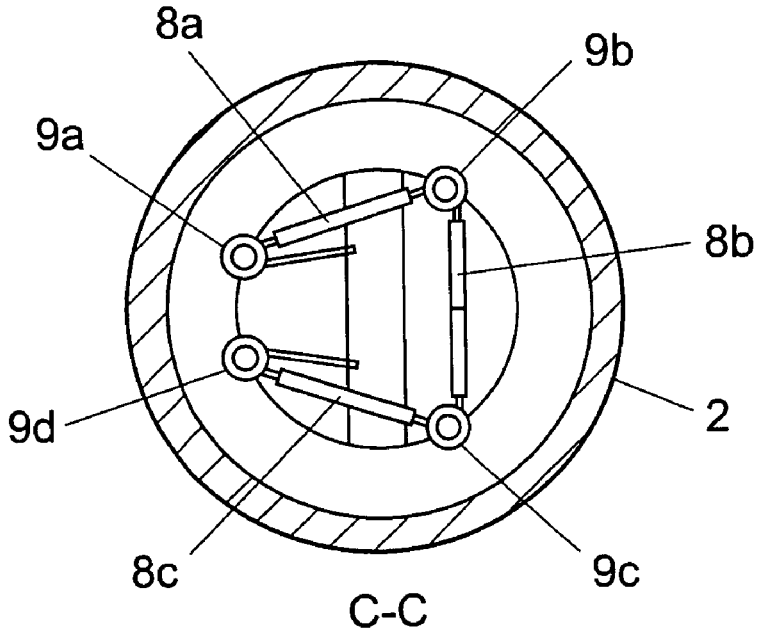
FIG. 1*d* shows a cross-sectional illustration of the reflector lamp according to the invention shown in FIG. 1*a* along the line CC.

Reference will be made below to FIG. 1*a* to 1*d,* which show schematic illustrations of a reflector lamp 1 according to the invention in a partially sectioned side view, a partially sectioned side view rotated through 90° with respect thereto, an end view and a cross-sectional illustration along the line CC. The reflector lamp 1 has a bowl-shaped lamp vessel 2 made from quartz glass having a diameter of approximately 20 mm, whose end side is sealed by an essentially planar end face 3. The lamp vessel 2 leads to a glass base 4 of the G9 type, i.e. for system voltage operation, which defines the lamp longitudinal axis L. Two outer power supply lines 5*a,* 5*b* which are bent in the form of loops protrude out of the glass base 4. The overall length of the reflector lamp 1, including the outer power supply lines 5*a,* 5*b,* is approximately 31 mm, and without said power supply lines 5*a,* 5*b,* i.e. from the end face 3 up to the end of the glass base 4, is only approximately 26 mm. In the interior of the glass base 4, two molybdenum foils 6*a,* 6*b* are sealed-in with a pinch seal in a gas-tight manner. Said molybdenum foils 6*a,* 6*b* are on the one hand connected to the outer power supply lines 5*a,* 5*b* and on the other hand to inner power supply lines 7*a,* 7*b.* The inner power supply lines 7*a,* 7*b* for their part end in an incandescent filament 8, which is used as the luminous element during lamp operation and has three filament segments 8*a*-8*c.* The three filament segments 8*a*-8*c* which incandesce during lamp operation are connected to one another via two uncoiled connecting sections and are arranged in the form of a rhombus in a plane perpendicular to the lamp longitudinal axis L, the open side of the imaginary rhombus leading to two inner power supply lines 7*a,* 7*b.* At the two uncoiled connecting sections and the two connecting points between the incandescent filament 8 and the two inner power supply lines 7*a,* 7*b,* the incandescent filament 8 is connected to the tips 9*a*-9*d* of in total four pinches 10*a*-10*d* which are turned in the form of funnels from the end face 3 into the lamp vessel 2. For this purpose, an uncoiled piece of filament wire section is fused into the glass material of the corresponding pinch tip 9*a*-9*d* at each of these mentioned four points. For this purpose, initially the entire incandescent filament 8 including the inner power supply lines 7*a,* 7*b* connected thereto is inserted into the lamp vessel 2 with the aid of a filament support (not illustrated) and is then fixed by means of the pinches 10*a*-10*d.* For this purpose, suitably shaped spikes (not illustrated) engage axially in the still soft glass material of the end face 3 of the lamp vessel 2, i.e. parallel to the lamp longitudinal axis L, at a correspondingly high temperature such that the mentioned filament wire sections can penetrate slightly the still soft pinch tips 9*a*-9*d,* preferably by the incandescent filament being almost stretched on the pinches circumferentially from the outside in order to achieve the required tensile force. The filament support in this case also acts as an opposing bearing. Alternatively, the incandescent filament can also be connected to the pinches by other auxiliary means or by an interlocking or force-fitting connection. Once the pinches 10*a*-10*d* are sufficiently hard owing to being cooled down, the filament support can be removed, and the reflector lamp can be sealed in a gas-tight manner by means of conventional pinch-sealing of the base. This takes place in an expedient manner in a suitable pressure chamber. For pinch-sealing the base, the glass is heated by means of a laser by the laser beam being injected into the pressure chamber through a suitable window. Before the base is pinch-sealed, the filling gas is also introduced into the pressure chamber and is consequently enclosed in the lamp vessel when the base is pinch-sealed. As a result, no exhaust tube needs to be attached to the end face 3, and consequently there is no tip disrupting the spatial distribution of the light emitted through the end face 3 once the exhaust tube has been sealed. Finally, the conical section of the outer side of the lamp vessel 2 is also provided with a light-reflective metallic reflector coating 11. This achieves an extremely compact reflector lamp for system voltage.

Figure 2A:
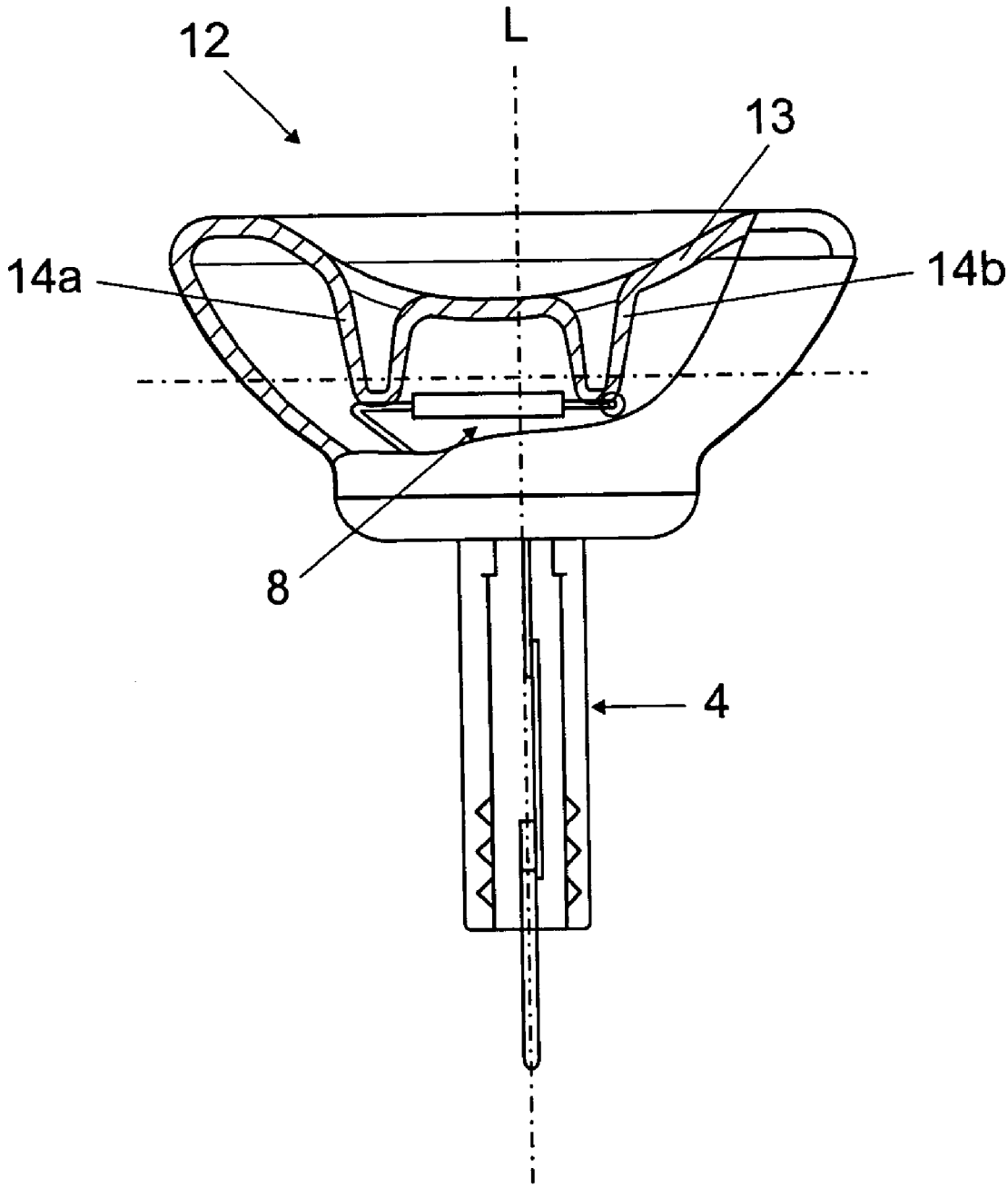
FIG. 2*a* shows a partially sectioned side view of one variant of the reflector lamp according to the invention shown in FIG. 1*a,* and FIG. 2*b* shows a partially sectioned side view, rotated through 90° compared with FIG. 2*a,* of the reflector lamp according to the invention shown in FIG. 2*a.*
Figure 2B:
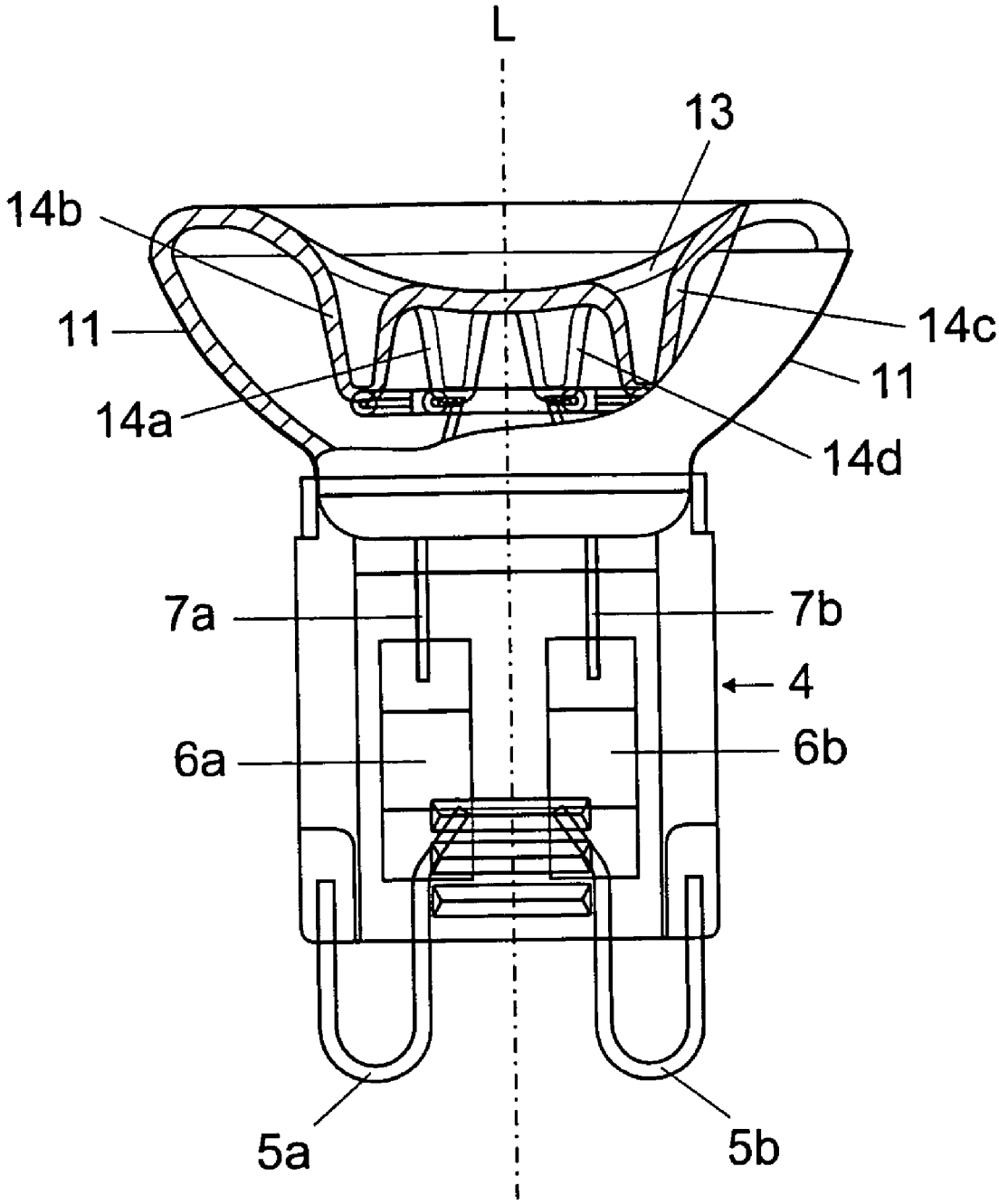

A partially sectioned side view and a partially sectioned side view rotated through 90° with respect thereto of a variant 12 of the reflector lamp shown in FIG. 1*a*-1*d* is illustrated schematically in FIGS. 2*a,* 2*b.* In this case, the same features are provided with the same references. The only difference consists in the fact that, with this variant, the end face 13 is not planar but is concavely curved. The pinches 14*a*-14*d,* however, are oriented axially, i.e. parallel to the lamp longitudinal axis L, as before.

What is claimed is:

1. An electric lamp having a lamp vessel, having a wall defining an enclosed volume, and a first power supply line and a second power supply extended through the wall in a sealed fashion;

a lamp base, which adjoins one end of the lamp vessel and, as a result, defines a lamp axis, a luminous element having a plurality of segments serially coupled electrically between the first power supply line and the second power supply line, the luminous element being, located within the lamp vessel and arranged essentially in an plane which is oriented perpendicularly with respect to the lamp axis, the segments being arranged in said plane around said lamp axis;

pinches, which are formed by turned-in sections of the lamp vessel and extend essentially parallel to the lamp axis, the pinches at least partially retaining the luminous element.

2. The electric lamp as claimed in claim 1, the turned-in sections forming the pinches being in the form of funnels.

3. The electric lamp as claimed in claim 1, the pinches being completely separated from one another or partially overlapping one another.

4. The electric lamp as claimed in claim 1, the luminous element being formed by an incandescent filament.

5. The electric lamp as claimed in claim 4, sections of the incandescent filament being embedded in each case in a pinch tip in the region of the pinches.

6. The electric lamp as claimed in claim 4, the incandescent filament having in each case one secondary winding in the region of the pinches, with which secondary windings the incandescent filament is retained fixedly at the pinch tips.

7. The electric lamp as claimed in claim 4, the incandescent filament being passed, under stress, to the outside around the pinches, as a result of which the incandescent filament is, as it were, stretched via the pinches.

8. The electric lamp as claimed in claim 4, the incandescent filament having filament segments with the number N, and the number of pinches being N+1.

9. The electric lamp as claimed in claim 8, in each case one pinch being provided between each pair of two adjacent filament segments and in each case one pinch being provided at a connection between the incandescent filament and the first power supply line, and at a connection between the incandescent filament and the second power supply line.

10. The electric lamp as claimed in claim 4, the incandescent filament having filament segments with the number N and being stretched in the form of an N+1-sided polygon, which is open on the side of the two power supply lines of the incandescent filament.

11. The electric lamp as claimed in claim 4 having four pinches, the incandescent filament being retained at its two power supply lines by in each case one pinch, and the remaining incandescent filament being retained by two further pinches, as a result of which in total three filament segments are defined between the pinches.

12. The electric lamp as claimed in claim 1, the lamp vessel having an essentially flat or at least only slightly concavely or convexly curved section which is opposite the base and having a conical section which tapers in the direction of the base.

13. The electric lamp as claimed in claim 12, the conical section being provided with a reflective coating.

14. The electric lamp as claimed in claim 1, the lamp base being formed from the material of the lamp vessel.

15. The electric lamp as claimed in claim 1, which is in the form of a halogen incandescent lamp for direct operation using the system voltage.

16. The electric lamp as claimed in claim 2, the pinches being completely separated from one another or partially overlapping one another.

* * * * *